US010598345B2

(12) United States Patent
Takeshita

(10) Patent No.: US 10,598,345 B2
(45) Date of Patent: Mar. 24, 2020

(54) ILLUMINATION APPARATUS

(71) Applicant: Panasonic Intellectual Property Management Co., Ltd., Osaka (JP)

(72) Inventor: Hironori Takeshita, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/443,035

(22) Filed: Jun. 17, 2019

(65) Prior Publication Data

US 2020/0003393 A1 Jan. 2, 2020

(30) Foreign Application Priority Data

Jun. 28, 2018 (JP) ..... 2018-123605

(51) Int. Cl.

| | |
|---|---|
| ***F21V 9/02*** | (2018.01) |
| ***F21V 3/06*** | (2018.01) |
| ***F21S 8/02*** | (2006.01) |
| ***F21V 3/04*** | (2018.01) |
| *F21W 121/00* | (2006.01) |

(52) U.S. Cl.

CPC ..... *F21V 9/02* (2013.01); *F21S 8/026* (2013.01); *F21V 3/049* (2013.01); *F21V 3/0625* (2018.02); *F21W 2121/008* (2013.01)

(58) Field of Classification Search

CPC ..... F21V 9/02; F21V 3/0625; F21V 3/049; F21S 8/026; F21W 2121/008

See application file for complete search history.

(56) References Cited

U.S. PATENT DOCUMENTS

| | | | |
|---|---|---|---|
| 2007/0110957 | A1 | 5/2007 | Higashi et al. |
| 2007/0291366 | A1 | 12/2007 | Murata et al. |
| 2009/0165943 | A1 | 7/2009 | Kim |
| 2014/0133125 | A1 | 5/2014 | Di Trapani et al. |
| 2016/0327697 | A1 | 11/2016 | Sugiyama |

(Continued)

FOREIGN PATENT DOCUMENTS

| | | | |
|---|---|---|---|
| JP | S58-066203 | A | 4/1983 |
| JP | S62-058291 | A | 3/1987 |
| JP | S63-022634 | A | 1/1988 |

(Continued)

*Primary Examiner* — Joseph L Williams

(74) *Attorney, Agent, or Firm* — McDermott Will & Emery LLP

(57) ABSTRACT

An illumination apparatus includes a plurality of light emitters, and a light control component that transmits light emitted from the plurality of light emitters. The light control component includes a first diffusion layer and a second diffusion layer. A first perpendicular haze is lower than a first diagonal haze, the first perpendicular haze indicating a diffusion degree of light traveling perpendicular to a light emission surface of the first diffusion layer, and the first diagonal haze indicating a diffusion degree of light traveling diagonal to the light emission surface of the first diffusion layer. A second perpendicular haze is higher than a second diagonal haze, the second perpendicular haze indicating a diffusion degree of light traveling perpendicular to a light emission surface of the second diffusion layer, and the second diagonal haze indicating a diffusion degree of light traveling diagonal to the light emission surface of the second diffusion layer.

20 Claims, 6 Drawing Sheets

(56) References Cited

U.S. PATENT DOCUMENTS

2017/0192137 A1 7/2017 Sakano et al.

FOREIGN PATENT DOCUMENTS

| | | | |
|---|---|---|---|
| JP | H01-176603 | A | 7/1989 |
| JP | H03-014747 | A | 1/1991 |
| JP | H04-086691 | A | 3/1992 |
| JP | H04-086692 | A | 3/1992 |
| JP | H05-011118 | A | 1/1993 |
| JP | H10-134616 | A | 5/1998 |
| JP | H10-144121 | A | 5/1998 |
| JP | 2004-296343 | A | 10/2004 |
| JP | 2004-355939 | A | 12/2004 |
| JP | 2005-265915 | A | 9/2005 |
| JP | 2005-292217 | A | 10/2005 |
| JP | 2005-292219 | A | 10/2005 |
| JP | 2006-119241 | A | 5/2006 |
| JP | 2006-293085 | A | 10/2006 |
| JP | 2009-528567 | A | 8/2009 |
| JP | 2015-191178 | A | 11/2015 |
| JP | 2015-195082 | A | 11/2015 |
| JP | 2015-222441 | A | 12/2015 |
| JP | 2016-514340 | A | 5/2016 |
| JP | 2016-194573 | A | 11/2016 |
| JP | 2016-194687 | A | 11/2016 |
| WO | 2007/106285 | A1 | 9/2007 |
| WO | 2014/076656 | A1 | 5/2014 |

ILLUMINATION APPARATUS

CROSS REFERENCE TO RELATED APPLICATION

This application claims the benefit of priority of Japanese Patent Application Number 2018-123605 filed on Jun. 28, 2018, the entire content of which is hereby incorporated by reference.

BACKGROUND

1. Technical Field

The present disclosure relates to an illumination apparatus, and in particular to an illumination apparatus for simulating a sensation that the sky can be seen from indoors through a window.

2. Description of the Related Art

An illumination system that can reproduce a sensation that sunlight is illuminating a room through a window is conventionally known (see, for example, Japanese Unexamined Patent Application Publication (Translation of PCT Application) No. 2016-514340). With the illumination system disclosed in Japanese Unexamined Patent Application Publication (Translation of PCT Application) No. 2016-514340, a user is given the impression as if light from a light-emitting diode (LED) light source diffused by a diffusion panel were sunlight by causing the user to experience that an endless space is present beyond the diffusion panel.

In an illumination apparatus in which light from an LED light source including two-dimensionally arranged light emitters, e.g. LEDs, is diffused by a diffusion panel, the light from the light-emitters is diffused by the diffusion panel so that the two-dimensionally arranged light emitters are not visible as dots when the illumination apparatus is looked at head-on (perpendicular). In other words, the light from the light emitters is blurred by the diffusion panel.

Conventional illumination apparatuses, however, face the problem that display images projected by the display panel are too blurry when looking at the illumination apparatus diagonally when video light is generated by the light from the light emitters.

In order to solve this problem, the present disclosure aims to provide an illumination apparatus that can project a display image without much blur even when looking at the illumination apparatus perpendicularly or diagonally.

SUMMARY

In order to achieve the above objective, an aspect of an illumination apparatus according to the present disclosure includes a plurality of light emitters arranged two-dimensionally, and a light control component that transmits light emitted from the plurality of light emitters. The light control component includes a first diffusion layer and a second diffusion layer, each diffusing the light to be transmitted. A first perpendicular haze is lower than a first diagonal haze, the first perpendicular haze indicating a diffusion degree of light traveling perpendicular to a light emission surface of the first diffusion layer, and the first diagonal haze indicating a diffusion degree of light traveling diagonal to the light emission surface of the first diffusion layer. A second perpendicular haze is higher than a second diagonal haze, the second perpendicular haze indicating a diffusion degree of light traveling perpendicular to a light emission surface of the second diffusion layer, and the second diagonal haze indicating a diffusion degree of light traveling diagonal to the light emission surface of the second diffusion layer.

This makes it possible to realize an illumination apparatus that can project a display image without much blur even when looking at the illumination apparatus perpendicularly or diagonally.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF THE EMBODIMENT

Figure 1:
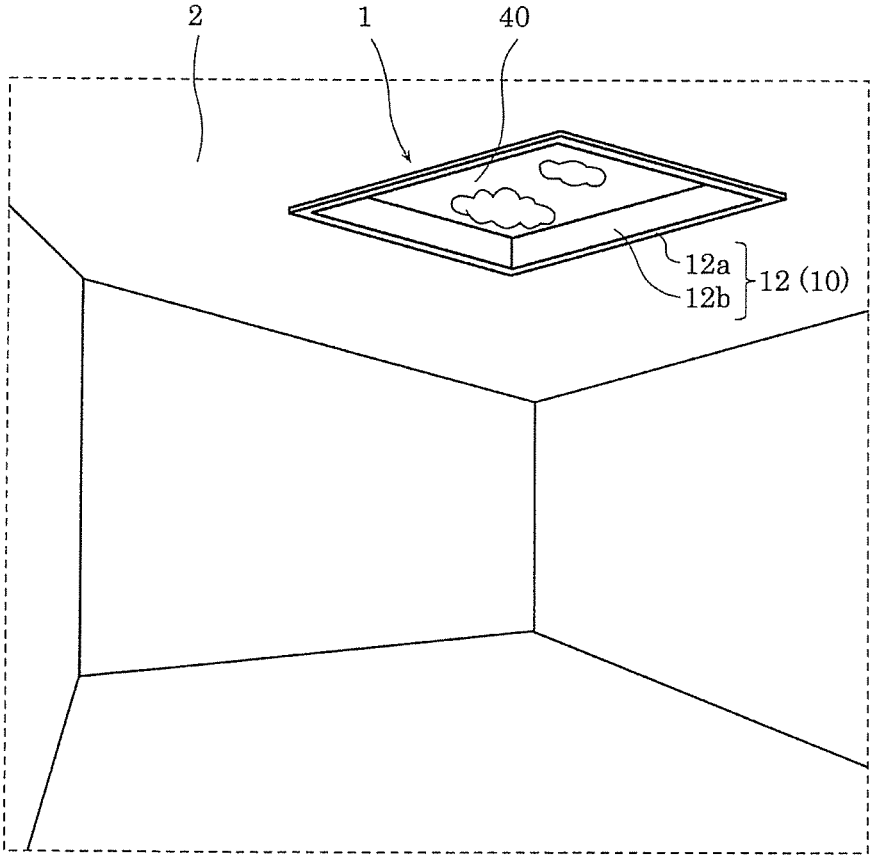
FIG. 1 is a diagram showing an installation example of an illumination apparatus according to an embodiment.

Hereinafter, an embodiment in the present disclosure will be described. Note that the embodiment described below shows a specific example in the present disclosure. Therefore, numerical values, shapes, materials, components, placement and connection of the components, and the like are mere examples and are not intended to limit the present disclosure. Components in the following embodiment not mentioned in any of the independent claims that define the broadest concepts are described as optional elements.

Note that the drawings are schematic diagrams and do not necessarily provide strictly accurate illustrations. The scales and the like in the drawings do, therefore, not necessarily coincide. Note that in the drawings, components that are substantially the same as components described previous thereto have the same reference numerals and overlapping descriptions are omitted or simplified.

Embodiment

Figure 2:
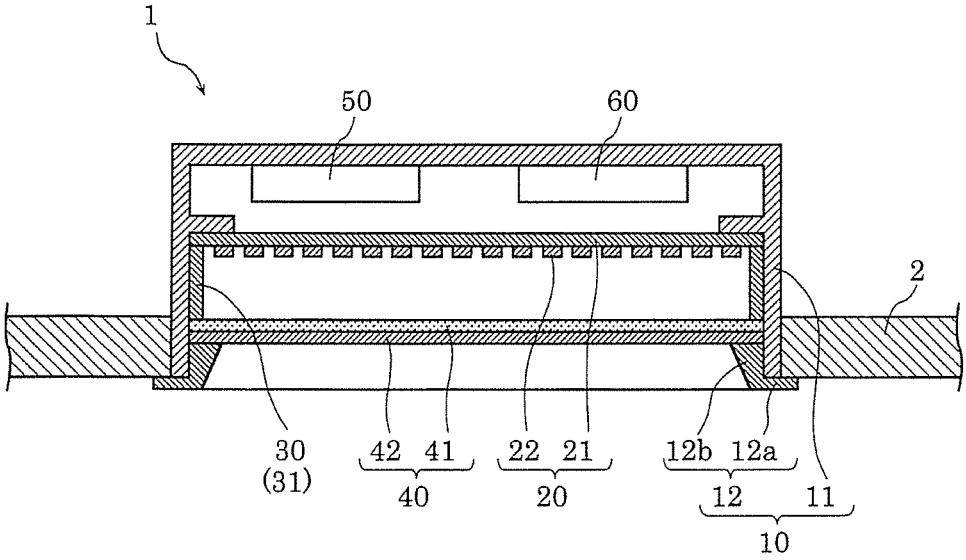
FIG. 2 is a cross-sectional view of the illumination apparatus installed in a ceiling.
Figure 3:
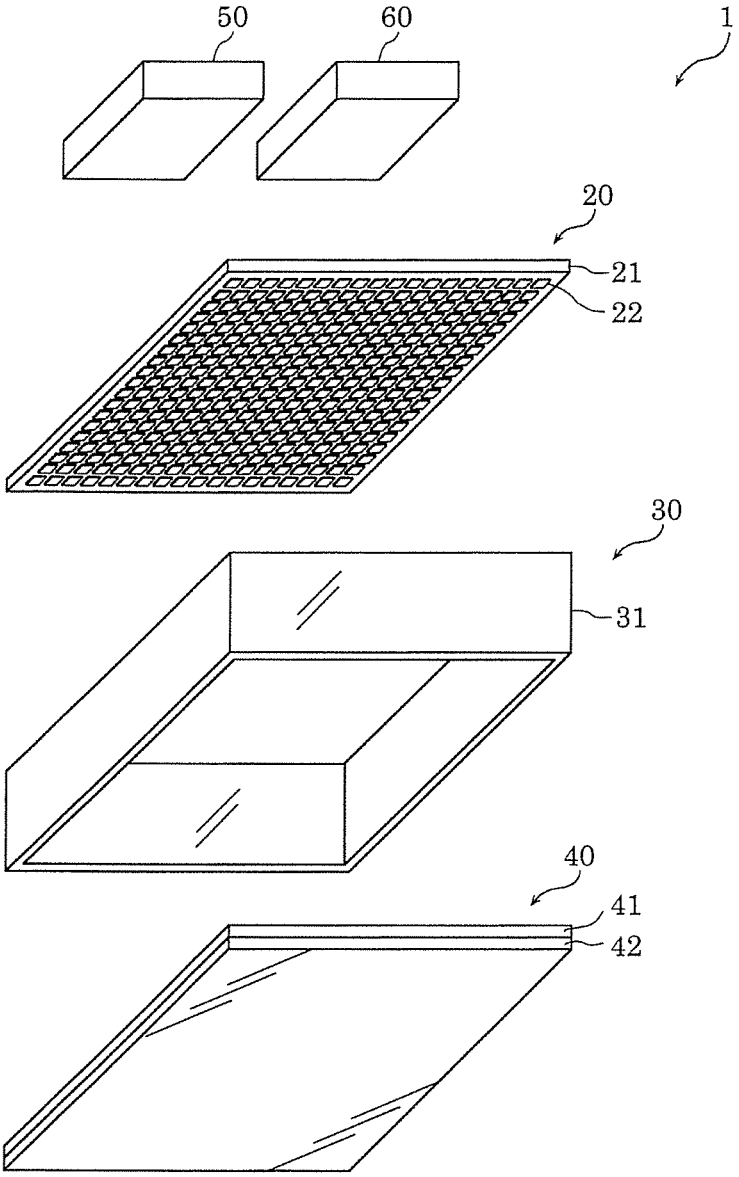
FIG. 3 is an exploded perspective view of a configuration of components of the illumination apparatus excluding a casing thereof according to the embodiment.

A configuration of illumination apparatus 1 according to an embodiment will first be described with reference to FIGS. 1 to 3. FIG. 1 is a diagram showing an installation example of illumination apparatus 1 according to the embodiment. FIG. 2 is a cross-sectional view of illumination apparatus 1 installed in a ceiling; FIG. 3 is an exploded perspective view of the configuration of components of the same illumination apparatus 1 excluding casing 10 thereof.

As illustrated in FIG. 1, illumination apparatus 1 is a ceiling-embedded luminaire embedded in ceiling 2 of a building, e.g. a residence, facility, or store, and radiates illumination light downward (e.g. to a floor).

Illumination apparatus 1 (i) is an apparatus for simulating an experience that allows a user to have a sensation that the sky can be seen from indoors through a window, (ii) and radiates video light as illumination light. For example, illumination apparatus 1 simulates light imitating a natural sky (e.g. a blue sky or sunset sky) seen from indoors through a window. In other words, illumination apparatus 1 shows a display image (simulation video) of clouds floating through the sky and the like.

As illustrated in FIGS. 2 and 3, illumination apparatus 1 includes casing 10, light-emitting module 20, light reflector 30, light control component 40, control unit 50, and power source unit 60.

Casing 10 is an enclosure component of illumination apparatus 1. Casing 10 accommodates light-emitting module 20, light reflector 30, light control component 40, control unit 50, and power source unit 60. Casing 10 is, for example, a flat box, and is substantially rectangular in a plan view. Note that casing 10 is not limited to being substantially rectangular, and may also be substantially circular, substantially polygonal, substantially semicircular, or the like.

In the present embodiment, casing 10 includes housing 11 having an aperture, and a frame-shaped frame 12 having a through-hole. Housing 11 and frame 12 are fixed to each other with fastening components, screws, via a locking structure, or the like.

Housing 11 is a flat box accommodating light-emitting module 20, light reflector 30, light control component 40, control unit 50, and power source unit 60. An accommodation space of housing 11 is, for example, a cuboid. Note that control unit 50 and power source unit 60 do not need to be accommodated by housing 11, and may also be disposed, for example, exterior to casing 10. Housing 11 has an aperture facing a floor, and accommodates light control component 40 so that this aperture is covered. In other words, a size of the aperture of housing 11 is appropriate for accommodating light control component 40. In the present embodiment, the aperture of housing 11 is substantially rectangular in the plan view.

Frame 12 is attached to an end portion of housing 11 approximate to the aperture. To be specific, frame 12 surrounds the aperture of housing 11. Accordingly, an aperture of the through-hole of frame 12 and the aperture of housing 11 have substantially the same shape in the plan view of illumination apparatus 1. In the present embodiment, the opening of frame 12 is substantially rectangular in the plan view. Note that frame 12 is not limited to being substantially rectangular, and may also be substantially circular, substantially polygonal, substantially semicircular, or the like.

Frame 12 is disposed on the side of a light emission surface of light control component 40. Accordingly, light emitted from light control component 40 passes through the through-hole of frame 12 and is emitted outward. A contour of the illumination light radiated from illumination apparatus 1 is, therefore, the same shape as the aperture of the through-hole of frame 12.

In the present embodiment, frame 12 includes a frame-shaped front surface section 12*a* and a frame-shaped raised section 12*b*.

Front surface section 12*a* protrudes outward from an end portion of raised section 12*b* like a flange. Illumination apparatus 1 is, for example, recessed in ceiling 2 so that front surface section 12*a* is substantially flush with a surface of ceiling 2. In other words, front surface section 12*a* is a finished surface that is visible to the user. Thus, front surface section 12*a* may be designed in harmony with ceiling 2. For example, front surface section 12*a* may have a design that imitates a pattern of the ceiling surface or window frame.

Raised section 12*b* is a lateral wall that extends from an end portion of an aperture of front surface section 12*a* toward the ceiling. By disposing raised section 12*b*, a more realistic window can be simulated. In other words, supposing that light control component 40 and the surface of ceiling 2 are flush without disposing raised section 12*b*, the user will see a thin frame (e.g. a thin frame with the same thickness as light control component 40) in ceiling 2, and the window will be appear less realistic as architectural structure, but a more realistic window can be simulated by disposing raised section 12*b* and disposing light control component 40 further away from the surface of ceiling 2. A height (vertical length) of raised section 12*b* may be, for example, large enough so that illumination apparatus 1 embedded in ceiling 2 seems like a thick frame, and may be, for example, at least 30 mm.

Note that in the present embodiment, an inner surface of raised section 12*b* (raised surface) is slanted, but may also be vertical.

Casing 10 configured as such may be manufactured using, for example, a metal or resin. In other words, housing 11 and frame 12 include a metal or resin. Housing 11 and frame 12 may include different materials, or may also include the same material.

To give an example, housing 11 is a metal product, and is, for example, box-shaped by press working a metal plate, e.g. an aluminum alloy plate or copper plate. Note that housing 11 is not limited to being a metal product, and may also be a resin product. In this case, housing 11 may include a resin with high thermal conductivity. This makes it possible to efficiently dissipate heat generated by light-emitting module 20 outward via casing 10 when housing 11 includes a metal or resin with high thermal conductivity.

Frame 12 is a resin product, and is, for example, entirely made of an insulating resin. Note that frame 12 is not limited to being a resin product, and may also be a metal product. Raised section 12*b* of frame 12 receives a portion of the light emitted from light control component 40. Accordingly, raised section 12*b* may include a light-reflective material. For example, raised section 12*b* may include a metal or highly light-reflective material. To be specific, raised section 12*b* may include a white resin for scatter reflecting the received light, and may also be a molded metal product or a molded resin product with a metal reflective coating on an inner surface thereof for reflecting the received light through metallic reflection.

Note that in the present embodiment, housing 11 and frame 12 are separate components but may also be integrated as one component.

Light-emitting module 20 is a light source that generates the video light as the illumination light. As illustrated in FIG. 2 and FIG. 3, light-emitting module 20 includes substrate 21 and light emitters 22 disposed on a main surface of substrate 21.

Substrate 21 is a printed wiring assembly on which light emitters 22 are mounted. Substrate 21 can be, for example, a resin-based substrate, a metal-based substrate, or a ceramic substrate. Substrate 21 is, for example, rectangular in a plan view thereof, but is not limited thereto.

Light emitters 22 are arranged two-dimensionally. In the present embodiment, light emitters 22 are arranged in a matrix. To be specific, light emitters 22 are arranged in evenly-spaced rows and columns.

Light emitters 22 are LED elements including LEDs. The LED elements may be surface-mount devices (SMDs) or have a chip-on-board (COB) configuration.

In the present embodiment, light emitters 22 are RGB-type LED elements that emit blue, green, and red light (i.e., the three primary colors). In other words, one of light emitters 22 corresponds to one pixel, and, for example, includes a blue LED chip that emits blue light, a green LED chip that emits green light, and a red LED chip that emits red light. Note that light emitters 22 are not limited to being RGB-type LED elements, any may be, for example, RGBW-type LED elements that emits blue, green, red, and white light, and may also be LED elements that emit blue and white light only when a sky and clouds is displayed. Light emitters 22 are not limited to LED elements that can emit a plurality of colors, but may also be LED elements that emit only one of blue, green, red light (monochrome). In this case, light emitters 22 may be arranged in groups of three LED elements, each with one LED element that emits blue light, one LED element that emits green light, and one LED element that emits red light.

It is not illustrated, but substrate 21 includes (i) a control line that is wiring for transmitting a control signal from control unit 50, and (ii) an electric power line for supplying electric power from power source unit 60, both being disposed as printed wiring. Light emitters 22 are each supplied with electric power from power source unit 60 via the electric power line, and emit predetermined light based on the control signal from the control line. In the present embodiment, light emitters 22 can radiate light with various colors by adjusting the brightness of the blue, green, and red light since light emitters 22 are RGB-type LED elements. This makes it possible to generate video light that simulates, for example, a blue sky, a cloudy sky, or a sunset sky (simulated outdoor light). In other words, the light emitted from light emitters 22 is video light generated by changing at least one of a brightness or a color of each of light emitters 22.

A portion of the light radiated from light emitters 22 (light-emitting module 20) is reflected by light reflector 30. Light reflector 30 reflects the light radiated from light emitters 22. In the present embodiment, light reflector 30 reflects the light radiated from light emitters 22 toward light control component 40.

As illustrated in FIGS. 2 and 3, light reflector 30 surrounds light emitters 22. Light reflector 30 is a frame-shaped reflection plate that surrounds light emitters 22. Light reflector 30 is disposed between substrate 21 of light-emitting module 20 and light control component 40. Light control component 40 is disposed, for example, on a main surface of substrate 21 of light-emitting module 20.

In the present embodiment, light reflector 30 includes wall 31 surrounding light emitters 22. Wall 31 is disposed perpendicular to a main surface of substrate 21 of light-emitting module 20.

Light reflector 30 can include, for example, a resin or metal. To be specific, light reflector 30 may be a white resin product manufactured using a resin such as polybutylene terephthalate (PBT), a resin product with a metal film, e.g. aluminum, on an inner surface thereof, and a metallic component including a metal such as aluminum. Note that when light reflector 30 is a metallic component, a surface of light reflector 30 may receive a diffusion treatment such as an alumite treatment. In this case, the diffusion treatment should be performed on at least an inner surface of wall 31.

Light control component 40 that transmits the light transmitted by light emitters 22 is disposed along a light emission path of light emitters 22. To be specific, light control component 40 receives, among the light emitted from light emitters 22, (i) direct light that is not reflected by light reflector 30 and (ii) reflection light reflected by light reflector 30. The light incident on light control component 40 is diffused (scattered) by light control component 40 and transmitted through light control component 40. In other words, light control component 40 is a light-diffusing component that transmits and diffuses (scatters) light, and scatter reflects and transmits the incident light.

Light control component 40 includes first diffusion layer 41 and second diffusion layer 42, each diffusing (scatter reflecting) the light to be transmitted. In the present embodiment, first diffusion layer 41 is disposed closer to light-emitting module 20 than second diffusion layer 42. The light emitted from light emitters 22 is, therefore, transmitted first by first diffusion layer 41 and then second diffusion layer 42. In other words, the light emitted from light emitters 22 is incident on second diffusion layer 42 after being transmitted through first diffusion layer 41. Second diffusion layer 42, therefore, receives light transmitted through first diffusion layer 41. To be specific, second diffusion layer 42 faces the light emission surface of first diffusion layer 41.

In the present embodiment, first diffusion layer 41 and second diffusion layer 42 are separate components. To be specific, first diffusion layer 41 and second diffusion layer 42 are diffusion panels. The diffusion panels can be a diffusion sheet, diffusion film, diffusion panel, or the like.

Second diffusion layer 42 is laminated to first diffusion layer 41. In this case, first diffusion layer 41 and second diffusion layer 42 may be taped together by inserting glue or adhesive tape on an entire surface or only surroundings of first diffusion layer 41 and second diffusion layer 42, first diffusion layer 41 and second diffusion layer 42, which are laminated to each other without inserting an adhesive, may also be fixed to each other using, for example, fastening components such as a screw, holder, or the like.

First diffusion layer 41 and second diffusion layer 42 have different optical actions with respect to the incident light. The optical actions of first diffusion layer 41, second diffusion layer 42, and light control component 40 will be described with reference to FIG. 4.

Figure 4:
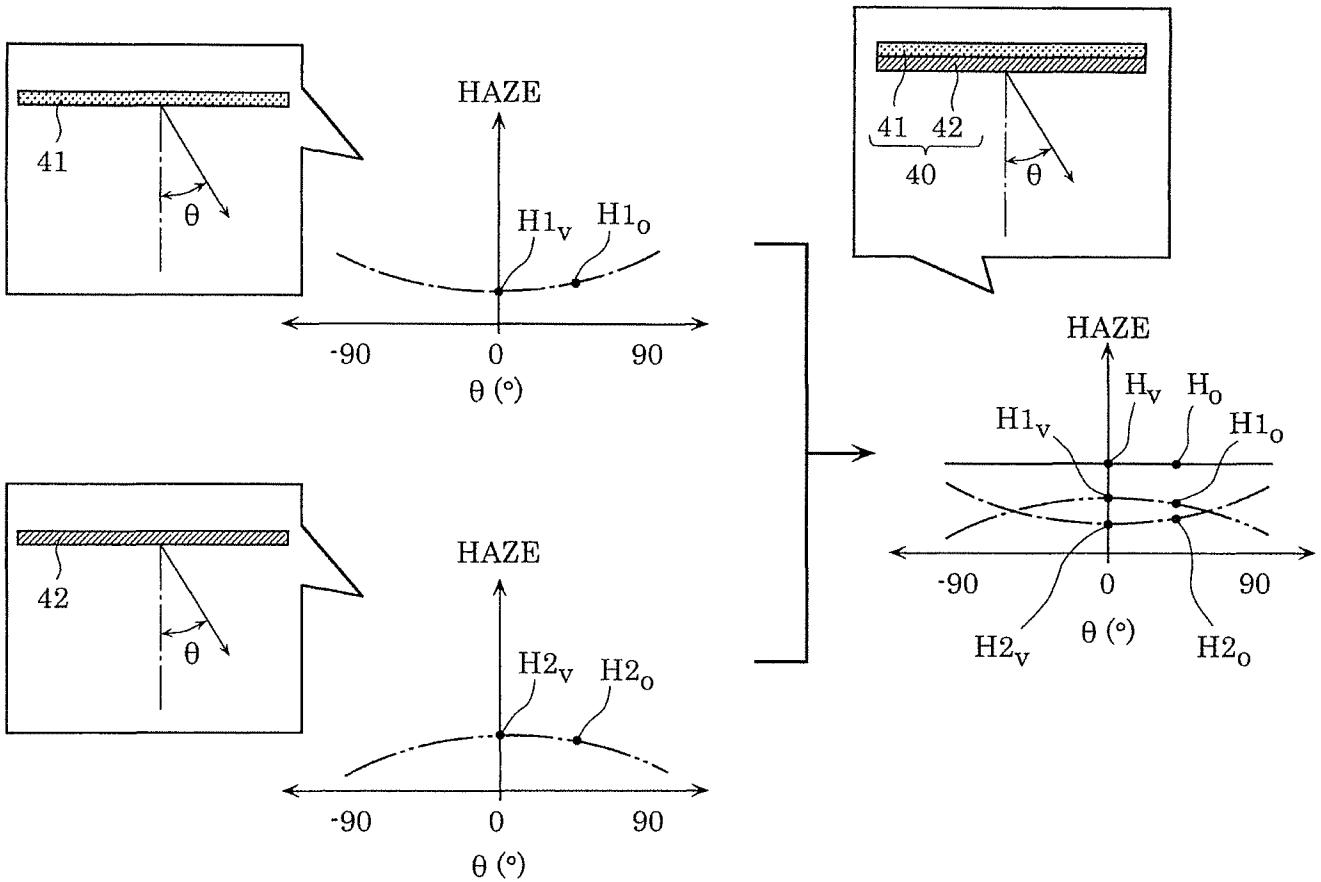
FIG. 4 is a diagram for describing an optical action of a light control component in the illumination apparatus according to the embodiment.

As illustrated in FIG. 4, diffusion degrees (hazes) with respect to emission angles of light incident on and emitted from first diffusion layer 41 and second diffusion layer 42, which make up light control component 40, differ.

First, regarding a haze with respect to emission angle θ of the light emitted from first diffusion layer 41, first perpendicular haze ($H1_v$) indicating a diffusion degree of light traveling perpendicular to a light emission surface of first diffusion layer 41 (emission angle θ=0°) is lower than first diagonal haze ($H1_o$) indicating a diffusion degree of light traveling diagonal to the light emission surface of first diffusion layer 41 (−90°<emission angle θ<90°), ($H1_v$<$H1_o$). First diagonal haze ($H1_o$) has a value of, for example, θ=±30°.

To be specific, first diffusion layer 41 has a diffusion action for which the haze with respect to emission angle θ of the light emitted from first diffusion layer 41 takes a value on a downward arching curve as illustrated with the dash-dotted line. In other words, first diffusion layer 41 has an optical action for which a straight transmittance decreases as emission angle θ is larger.

Regarding a haze with respect to emission angle θ of the light emitted from second diffusion layer 42, however, second perpendicular haze ($H2_v$) indicating a diffusion degree of light traveling perpendicular to a light emission surface of second diffusion layer 42 (emission angle θ=0°) is higher than second diagonal haze ($H2_o$) indicating a diffusion degree of light traveling diagonal to the light emission surface of second diffusion layer 42 (−90°<emission angle θ<90°), ($H2_v$<$H2_o$). Second diagonal haze ($H2_o$) has a value of, for example, θ=±30°.

To be specific, second diffusion layer 42 has a diffusion action for which the haze with respect to emission angle θ of the light emitted from second diffusion layer 42 takes a value on an upward arching curve as illustrated with the chain double-dashed line. In other words, second diffusion layer 42 has an optical action for which a straight transmittance increases as emission angle θ is larger.

More specifically, the haze of second diffusion layer 42 with respect to the incident light traveling perpendicular to an incidence surface of second diffusion layer 42 is high, and the haze of second diffusion layer 42 with respect to the incident light traveling diagonal to the incidence surface of second diffusion layer 42 is low. In other words, second diffusion layer 42 has a high diffusivity with respect to the incident light traveling perpendicular to the incidence surface of second diffusion layer 42, but has a low diffusivity and a high light-transmissivity with respect to the incident light traveling diagonal to the incidence surface of second diffusion layer 42.

In this manner, distribution curves of the hazes of first diffusion layer 41 and second diffusion layer 42 with respect to emission angle θ have opposite optical actions.

Therefore, as illustrated in FIG. 4, regarding a haze with respect to emission angle θ of the light emitted from light control component 40 including first diffusion layer 41 and second diffusion layer 42, perpendicular haze ($H_v$) indicating a diffusion degree of light traveling perpendicular to a light emission surface of light control component 40 (emission angle θ=0°) is roughly equal to diagonal haze ($H_o$) indicating a diffusion degree of light traveling diagonal to the light emission surface of light control component 40 (−90°<emission angle θ<90°), ($H_v \approx H_o$).

To be specific, light control component 40 has a diffusion action for which the haze with respect to emission angle θ of the light emitted from light control component 40 takes a roughly fixed value as illustrated with the solid line. In other words, light control component 40 has a diffusion action that is not dependent on emission angle θ of the light emitted from light control component 40.

Light control component 40 configured as such equalizes the hazes of light traveling perpendicular and diagonal to the light emission surface of light control component 40. When video light is generated by light emitters 22 and incident on light control component 40, light control component 40 equalizes a diffusion degree (scatter degree) of the video light generated by light emitters 22 when looking at the light emission surface of light control component 40 perpendicularly and diagonally.

In the present embodiment, perpendicular haze ($H_v$) of light control component 40 is at least 10% and at most 80%. Diagonal haze ($H_O$) of light control component 40 is, therefore, also at least 10% and at most 80%. Perpendicular haze ($H_v$) and diagonal haze ($H_O$) of light control component 40 are more preferably at least 20% and at most 70%. To give an example, perpendicular haze ($H_v$) and diagonal haze ($H_O$) of light control component 40 are approximately 60%. Note that second perpendicular haze ($H2_v$) of second diffusion layer 42 is higher than first perpendicular haze ($H1_v$) of first diffusion layer 41, but is not limited thereto.

A concrete example of first diffusion layer 41 and second diffusion layer 42 having the above optical actions will be described next.

First diffusion layer 41 and second diffusion layer 42 can be attained by including a transmission plate that diffuses light. The transmission plate can be a resin plate made of a resin such as acryl or polyethylene terephthalate (PET), a glass plate made of glass, or the like.

For example, first diffusion layer 41 and second diffusion layer 42 can be attained by using a transparent plate for the transmission plate, performing diffusion processing on this transmission plate, and forming a diffusive structure. In this case, the diffusion processing is performed on a surface of at least one of the incidence surfaces or light emission surfaces of first diffusion layer 41 and second diffusion layer 42. For example, there is prism processing during which a prism is formed including microscopic dot-shaped recesses and protrusions for the diffusion processing. Microscopic holes are small enough to be invisible to the user, and are, for example, cone-shaped or pyramidal. A depth determined by an apex and base of the microscopic holes (height of cone) and a diameter of the bottom of the microscopic holes when the holes are cone-shaped are, for example, at most 100 μm. Note that diffusion processing is not limited to prism processing, and may also be surface texturing or pattern printing of microscopic dots.

The diffusion actions of first diffusion layer 41 and second diffusion layer 42 can be caused to differ by performing different diffusion processing on first diffusion layer 41 and second diffusion layer 42.

To be specific, the diffusion action of first diffusion layer 41 indicated by the dash-dotted curve in FIG. 4 can be attained by performing uniform diffusion processing on an entire inner surface of first diffusion layer 41 and forming a uniform diffusive structure. First diffusion layer 41 configured as such has a similar structure to regular diffusion panels.

The diffusion action of second diffusion layer 42 indicated by the chain double-dashed curve in FIG. 4, however, can be attained by performing different diffusion processing on a portion of an inner surface of second diffusion layer 42. For example, in the inner surface of second diffusion layer 42, the optical action indicated by the chain double-dashed curve in FIG. 4 can be attained by (i) causing the size of the prisms, textures or printed dots to partially differ, (ii) causing the density of the prisms, textures or printed dots to partially differ, and (iii) causing the diffusive structure to have a different distribution.

Note that a method to cause first diffusion layer 41 and second diffusion layer 42 to have a diffusion action is not limited to performing diffusion processing on a transparent plate. To be specific, first diffusion layer 41 and second diffusion layer 42 may also use light-diffusive material. Minute light-reflective particles such as metallic particles, silica particles, refractive particles using a refractive index difference between the refractive particles and a matrix resin such as resin particles, and the like can be used for the light-diffusive material. In this case, first diffusion layer 41 and second diffusion layer 42 may be translucent white diffusion panels (translucent white panels) including light-diffusive material dispersed in a light-transmissive resin, e.g. acrylic or PET, and may also be translucent white diffusion membranes (translucent white films) including light-diffusive material dispersed on a surface or rear surface of an acrylic or PET transparent plate.

The diffusion actions of first diffusion layer 41 and second diffusion layer 42 can be caused to differ by performing different processing on first diffusion layer 41 and second diffusion layer 42 even when using light-diffusive material.

To be specific, the diffusion action indicated by the dash-dotted curve in can be attained for first diffusion layer 41 by uniformly dispersing light-diffusive material inside the translucent white plate or translucent white film. In other words, a concentration of the light-diffusive material in the entirety of first diffusion layer 41 is fixed (equal). First diffusion layer 41 configured as such has a similar structure to regular diffusion panels.

The diffusion action of second diffusion layer 42 indicated by the chain double-dashed curve in FIG. 4 can, however, be attained by causing the concentration (density) of the light-diffusive material therein to differ, or by causing a size or type of the light-diffusive material to differ in an inner surface of the translucent white panels or translucent white films.

Second diffusion layer 42 may also have a different structure from first diffusion layer 41. For example, second diffusion layer 42 may use a diffusion panel with a microscopic columnar structure (micropillars) uniformly disposed along a thickness of second diffusion layer 42.

Light control component 40 is a laminate of first diffusion layer 41 and second diffusion layer configured as such. Light control component 40 faces light-emitting module 20 and covers light-emitting module 20. To be specific, light control component 40 covers an aperture of casing 10. Light control component 40 includes the enclosure component of illumination apparatus 1, and the light emission surface of light control component 40 is an outer surface thereof. In other words, the light emission surface of light control component 40 is exposed. Accordingly, when the user looks up at ceiling 2, the user can see the light emission surface of light control component 40. To be specific, when the video light is emitted from light emitters 22 as the illumination light, a display image is shown on the light emission surface of light control component 40 (display surface) using the video light, along with the illumination light being radiated from light control component 40. Note that when the user looks up at ceiling 2, the user not only sees light control component 40, but can also see front surface section 12*a* and raised section 12*b* of frame 12.

Control unit 50 is an apparatus that follows instructions from the user (e.g. via a remote control), causes light-emitting module 20 to be turned on and off, and controls the light and color (light emission color or color temperature) of light-emitting module 20. For example, control unit 50 obtains information relating to a video stored in a storage (not illustrated) and reproduces the video in accordance with this information. For example, control unit 50 obtains information relating to a blue sky from the storage and controls light-emitting module 20 based on the obtained information when an instruction has been received from the user to display a blue sky. With this, video light is emitted based on a video of a blue sky from light-emitting module 20, and light control component 40 reproduces a video imitating a blue sky as the display image.

In the present embodiment, light emitters 22 are RGB-type LED elements. With this, control unit 50 outputs via the control line a control signal that include information relating to a brightness of each of the blue LED chips, green LED chips, and red LED chips in accordance with the instruction from the user. Light emitters 22 that have received the control signal emit blue, green, and red light with a predetermined light intensity based on this control signal.

Control unit 50 outputs, for example, the control signal to light-emitting module 20 at a time interval in which a movement of the display image emitted from light control component 40 does not become unnatural. For example, control unit 50 outputs the control signal approximately 20 times per second. This makes it possible to, for example, reproduce clouds with more natural movement when a video is reproduced of moving clouds.

Control unit 50 can be implemented with a microcomputer, processor, dedicated circuit or the like. Note that, as illustrated in FIG. 2, control unit 50 is disposed between a bottom surface of casing 10 and a surface opposite of a surface of substrate 21 of light-emitting module 20 on which light emitters 22 are mounted, but is not limited thereto.

Power source unit 60 includes (i) a power converter circuit that converts alternating current supplied from an electric power system (e.g. commercial power source) and the like to direct current, and (ii) a power circuit that generates electric power for causing light-emitting module 20 to emit light. Power source unit 60, for example, rectifies, smoothens, steps down, and the like the alternating current supplied from the commercial power source and converts the alternating current to direct current with a predetermined level. This direct current is then supplied to light-emitting module 20. Power source unit 60 is electrically connected to the electric power system via an electric power line and the like. Note that, as illustrated in FIG. 2, power source unit 60 is disposed between a bottom surface of casing 10 and a surface opposite of a surface of substrate 21 of light-emitting module 20 on which light emitters 22 are mounted similar to control unit 50, but is not limited thereto.

Illumination apparatus 1 configured as such can reproduce a display image with a sense of depth since illumination apparatus 1 includes a space surrounded by light reflector 30 between light-emitting module 20 and light control component 40. For example, when looking at illumination apparatus 1 from a different angle, illumination apparatus 1 can reproduce a display image with a sense of depth since the way the display image appears changes in accordance with the angle.

Illumination apparatus 1 in the present embodiment enables light control component 40 to project a display image without much blur even when looking at light control component 40 perpendicularly or diagonally since illumination apparatus 1 includes light control component 40 having first diffusion layer 41 and second diffusion layer 42. In other words, a display image not dependent on the viewing angle of the user can be reproduced on the light emission surface of light control component 40.

Figure 5A:
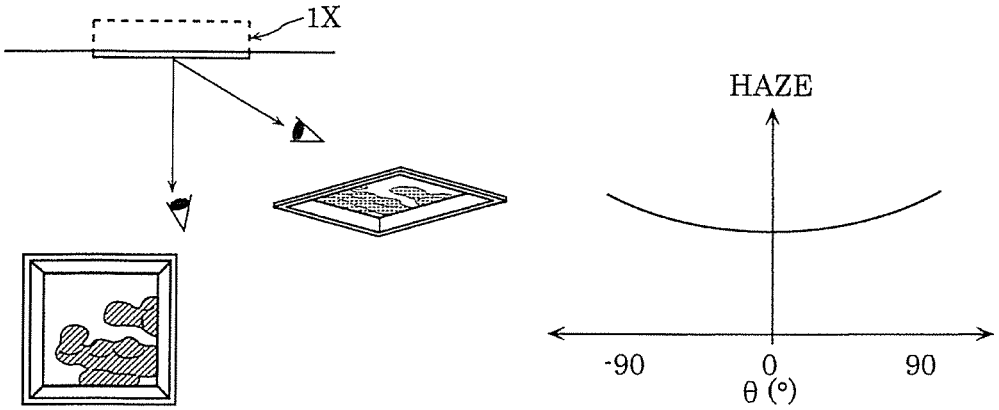
FIG. 5A is a diagram for describing how a display image of an illumination apparatus according to Comparative Example 1 is seen.
Figure 5B:
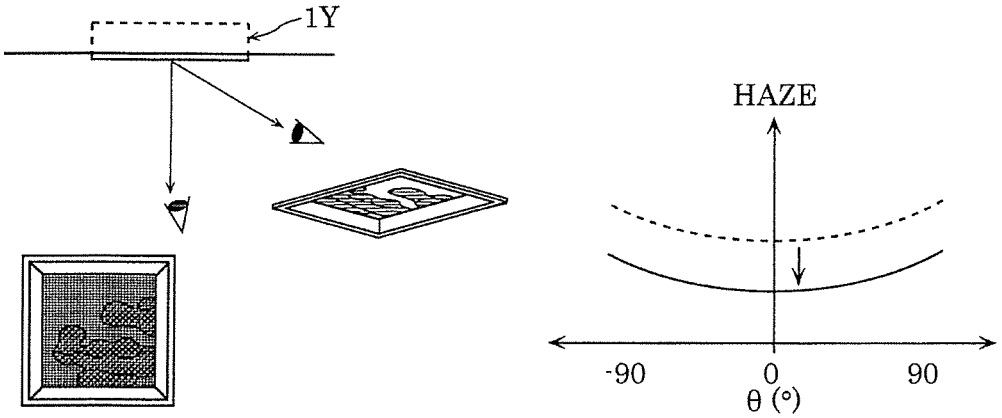
FIG. 5B is a diagram for describing how a display image of an illumination apparatus according to Comparative Example 2 is seen.
Figure 5C:
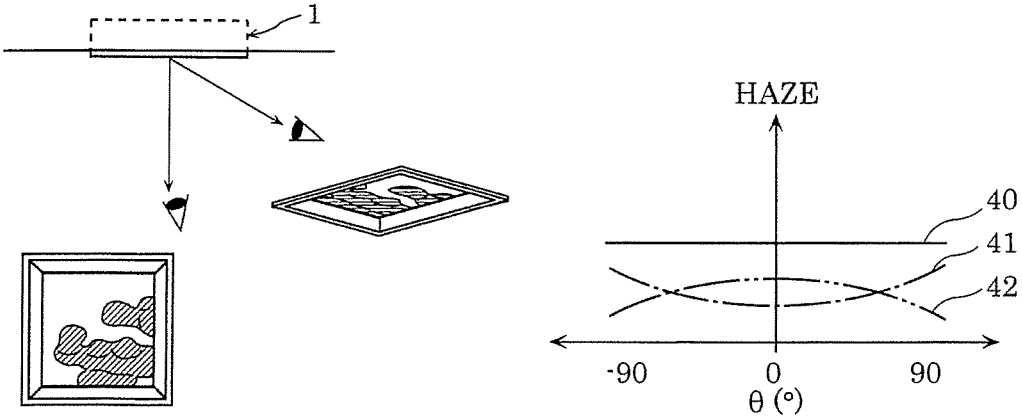
FIG. 5C is a diagram for describing how a display image of the illumination apparatus according to the embodiment is seen.

Hereinafter, this will be described with reference to FIGS. 5A to 5C. FIG. 5A is a diagram for describing how a display image of illumination apparatus 1X according to Comparative Example 1 is seen. FIG. 5B is a diagram for describing how a display image of illumination apparatus 1Y according to Comparative Example 2 is seen. FIG. 5C is a diagram for describing how a display image of illumination apparatus 1 according to the embodiment is seen.

In illumination apparatus 1X shown in FIG. 5A, a regular diffusion panel is used for the light control component. For example, illumination apparatus 1X, light control component 40 is a diffusion panel including only first diffusion layer 41 in illumination apparatus 1 shown in FIG. 2.

In this case, as illustrated in FIG. 5A, the display image displayed on the diffusion panel upon generating video light via light-emitting elements arranged two-dimensionally is not blurred when looking at a light emission surface of the diffusion panel perpendicularly, but the display image displayed on the diffusion panel does blur when looking at the light emission surface of the diffusion panel diagonally. To be specific, the display image blurs as an angle of the user's line of sight and a normal of the diffusion panel increases.

Accordingly, like illumination apparatus 1Y shown in FIG. 5B, a diffusion panel with a lower haze than the diffusion panel of illumination apparatus 1X shown in FIG. 5A can be used. In other words, a diffusion degree of the diffusion panel can be lowered.

Upon lowering the diffusion degree of the diffusion panel, however, the display image will not blur anymore when looking at the light emission surface of the diffusion panel diagonally, but the light-emitting elements arranged two-dimensionally will appear as dots when looking at the light emission surface of the diffusion panel perpendicularly. In other words, the light-emitting elements will give off a grainy impression from beyond the diffusion panel.

In contrast, illumination apparatus 1 according to the present embodiment uses light control component 40 including second diffusion layer 42 laminated to first diffusion layer 41. Therefore, as illustrated in FIG. 5C, light emitters 22 arranged two-dimensionally will not appear as dots when looking at the light emission surface of light control component 40 perpendicularly or diagonally, and the display image displayed by light control component 40 will not blur. In other words, it is possible to decrease the angle dependency of the blurring of the display image.

Illumination apparatus 1 according to the present embodiment includes (i) first diffusion layer 41 whose perpendicular haze is lower than its diagonal haze and (ii) second diffusion layer 42 whose perpendicular haze is higher than its diagonal haze as light control component 40 that transmits the light emitted from light emitters 22 arranged two-dimensionally.

This configuration makes it possible to realize an illumination apparatus that can project a display image without much blur even when looking at the illumination apparatus perpendicularly or diagonally. For example, the user can see a satisfactory display image of a sky and clouds even when looking up at illumination apparatus 1 installed in ceiling 2 from right below or looking at illumination apparatus 1 from far away. This makes it possible to give the user the impression that the sky is present in the distance like a real sky (sense of depth). In other words, the user can be given the sensation that they are looking at the sky from indoors through a window without making them feel that anything is out of place while the display image is projected by illumination apparatus 1.

Variations

An illumination apparatus according to the present disclosure has been described based on the embodiment, but the present disclosure is not limited thereto.

For example, in the above embodiment, as illustrated in FIG. 4, the haze of light control component 40 is fixed with emission angle θ being within the range of $-90° < \theta < 90°$, but is not limited thereto.

Figure 6:
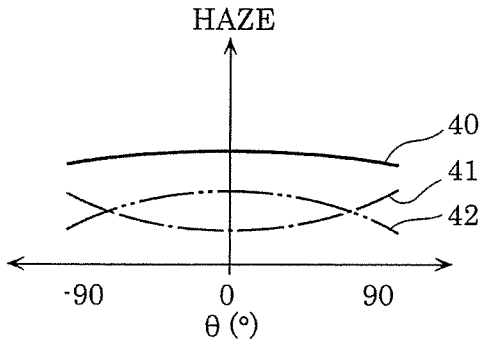
FIG. 6 is a diagram for describing an optical action of the light control component in the illumination apparatus according to Variation 1.

To be specific, as illustrated in FIG. 6, a diagonal haze of light control component 40 may be slightly lower. In this case, when diagonal hazes of first diffusion layer 41 and second diffusion layer 42 are slightly lower and perpendicular hazes of first diffusion layer 41 and second diffusion layer 42 are slightly higher, the diagonal haze of light control component 40 becomes slightly lower.

Figure 7:
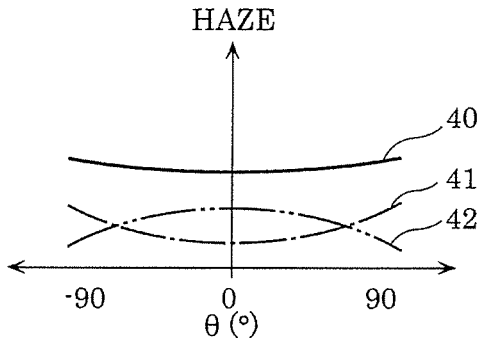
FIG. 7 is a diagram for describing an optical action of the light control component in the illumination apparatus according to Variation 2.

As illustrated in FIG. 7, the diagonal haze of light control component 40 may also be slightly higher. In this case, when the diagonal hazes of first diffusion layer 41 and second diffusion layer 42 are slightly higher and the perpendicular hazes of first diffusion layer 41 and second diffusion layer 42 are slightly lower, the diagonal haze of light control component 40 becomes slightly higher.

Figure 8:
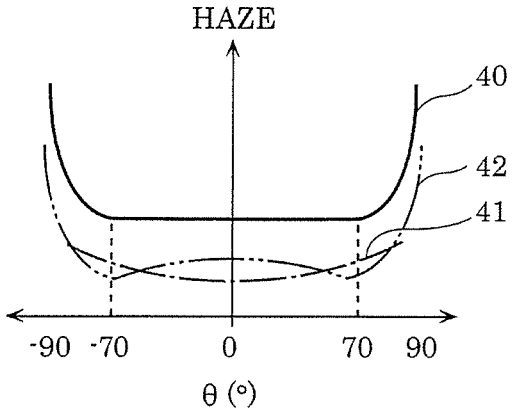
FIG. 8 is a diagram for describing an optical action of the light control component in the illumination apparatus according to Variation 3.

When illumination apparatus 1 is installed in ceiling 2, the user can no longer see the display image projected by the light emission surface of light control component 40 as a video when the angle of the normal of the light emission surface of light control component 40 and the user's line of sight exceed 70°. The haze of light control component 40 may, therefore, be substantially fixed with the angle of the normal of the light emission surface of light control component 40 and the user's line of sight being at most 70°. Accordingly, as illustrated in FIG. 8, the haze of light control component 40 may fluctuate in accordance with emission angle θ being $\theta < -70°$ and $70° < \theta$ when the haze of light control component 40 is fixed with emission angle θ being within $-70° \leq \theta \leq 70°$ with respect to the light emission surface of light control component 40. For example, in FIG. 8, the haze of light control component 40 is higher as emission angle θ is greater, emission angle θ being within the range of $\theta < -70°$ and $70° < \theta$. In this case, for example, a component with a diagonal haze for which emission angle θ is $\theta < -70°$ and $70° < \theta$ increases drastically higher as emission angle θ becomes larger is used for second diffusion layer 42.

In the above embodiment, first diffusion layer 41 and second diffusion layer 42 are disposed so that first diffusion layer 41 is on an inside (on the side of light-emitting module 20) and second diffusion layer 42 is on the outside, but are not limited thereto. For example, first diffusion layer 41 and second diffusion layer 42 may be disposed the other way around so that second diffusion layer 42 is on the inside and first diffusion layer 41 is on the outside.

In the above embodiment, first diffusion layer 41 and second diffusion layer 42 are separate components each including a diffusion panel, but are not limited thereto. For example, first diffusion layer 41 and second diffusion layer 42 may be integrated as one diffusion panel. For example, first diffusion layer 41 is the diffusion panel, second diffusion layer 42 is disposed as a rear surface layer of the diffusion panel. In this case, diffusion processing is performed on the diffusion panel and second diffusion layer 42 can be formed with a diffusive structure.

In the above embodiment, light control component 40 includes only first diffusion layer 41 and second diffusion layer 42, but is not limited thereto. For example, light control component 40 may also include a third layer such as a transparent substrate that supports first diffusion layer 41 and second diffusion layer 42.

In illumination apparatus 1 in the above embodiment, light control component 40 projects a display image due to light emitters 22 generating video light based on a video of clouds and the like, but is not limited thereto. For example, light control component 40 may also project a display image that is a pattern due to light emitters 22 generating illumination light having a contrast difference.

In the above embodiment, casing 10 includes frame 12, but is not limited thereto. For example, frame 12 may be included as a portion of ceiling 2 without being disposed in casing 10.

In the above embodiment, an example of illumination apparatus 1 being embedded in ceiling 2 has been described, but is not limited thereto. For example, illumination apparatus 1 may also be embedded in a building material other than ceiling 2, e.g. a wall.

In the above embodiment, illumination apparatus 1 includes casing 10 and light reflector 30, but is not limited thereto. In other words, illumination apparatus 1 does not need to include casing 10, and also does not need to include light reflector 30.

In the above embodiment, illumination apparatus 1 includes casing 10 and light reflector 30 as separate components, but is not limited thereto. For example, light reflector 30 and casing 10 may be integrated as one component.

In the above embodiment, an example of control unit 50 controlling light-emitting module 20 so that a display image is reproduced in accordance with an instruction of the user has been described, but is not limited thereto. For example, control unit 50 may obtain a state of the sky from a capturing apparatus that captures the state of the sky (e.g. a camera), and reproduce the obtained display image that imitates the state of the sky.

In the above embodiment, an example of control unit 50 reproducing a display image in accordance with an instruction of the user has been described, but is not limited thereto. For example, control unit 50 may (i) include a time function, (ii) obtain, from a storage, information relating to a video corresponding to a time when an instruction has been received from the user, and (iii) control light-emitting module 20 based on the obtained information. Control unit 50 may also obtain, from the storage, information relating to a video when it is a predetermined time, and control light-emitting module 20 based on the obtained information.

While the foregoing has described one or more embodiments and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. An illumination apparatus, comprising:

a plurality of light emitters arranged two-dimensionally; and a light control component that transmits light emitted from the plurality of light emitters, wherein the light control component includes a first diffusion layer and a second diffusion layer, each diffusing the light to be transmitted, a first perpendicular haze is lower than a first diagonal haze, the first perpendicular haze indicating a diffusion degree of light traveling perpendicular to a light emission surface of the first diffusion layer, and the first diagonal haze indicating a diffusion degree of light traveling diagonal to the light emission surface of the first diffusion layer, and a second perpendicular haze is higher than a second diagonal haze, the second perpendicular haze indicating a diffusion degree of light traveling perpendicular to a light emission surface of the second diffusion layer, and the second diagonal haze indicating a diffusion degree of light traveling diagonal to the light emission surface of the second diffusion layer.

2. The illumination apparatus according to claim 1, wherein the second perpendicular haze is higher than the first perpendicular haze.

3. The illumination apparatus according to claim 1, wherein a perpendicular haze indicating a diffusion degree of light traveling perpendicular to a light emission surface of the light control component is at least 10% and at most 80%.

4. The illumination apparatus according to claim 1, wherein the light emitted from the plurality of light emitters is video light generated by changing at least one of a brightness and a color of each of the plurality of light emitters.

5. The illumination apparatus according to claim 1, wherein the second diffusion layer receives light transmitted through the first diffusion layer.

6. The illumination apparatus according to claim 5, wherein the second diffusion layer faces the light emission surface of the first diffusion layer.

7. The illumination apparatus according to claim 6, wherein the first diffusion layer and the second diffusion layer are diffusion panels, and the second diffusion layer is laminated to the first diffusion layer.

8. The illumination apparatus according to claim 1, wherein the second diffusion layer has a different structure from the first diffusion layer.

9. The illumination apparatus according to claim 8, wherein the second diffusion layer is a diffusion panel with a uniform columnar structure along a thickness of the second diffusion layer.

10. The illumination apparatus according to claim 1, further comprising:

a light reflector that reflects the light emitted from the plurality of light emitters to the light control component.

11. An illumination apparatus, comprising:

a plurality of light emitters arranged two-dimensionally; and a light control component that transmits light emitted from the plurality of light emitters, wherein when video light is generated as light emitted from the plurality of light emitters by changing at least one of a brightness and a color of each of the plurality of light emitters, the light control component equalizes a diffusion degree of the video light when looking at a light emission surface of the light control component perpendicularly and diagonally.

12. The illumination apparatus according to claim 11, wherein the video light simulates a natural sky.

13. The illumination apparatus according to claim 1, wherein the plurality of light emitters are arranged in a matrix.

14. The illumination apparatus according to claim 1, wherein the plurality of light emitters each include a blue light-emitting diode (LED) chip that emits blue light, a green LED chip that emits green light, and a red LED chip that emits red light.

15. The illumination apparatus according to claim 1, further comprising:

a substrate on which the plurality of light emitters are mounted, and a light reflector that surrounds the plurality of light emitters, wherein the light reflector is disposed between the substrate and the light control component.

16. The illumination apparatus according to claim 15, wherein the light reflector includes a wall that surrounds the plurality of light emitters, and the wall is disposed perpendicular to a main surface of the substrate.

17. The illumination apparatus according to claim 1, wherein the illumination apparatus is recessed in a ceiling.

18. The illumination apparatus according to claim 17, further comprising:

a housing that has an aperture and accommodates the plurality of light emitters and the light control component, and a casing having a frame attached to an end portion of the housing proximate to the aperture, wherein the frame is disposed on the side of a light emission surface of the light control component.

19. The illumination apparatus according to claim 18, wherein the frame includes a front surface section that is frame-shaped, and a raised section that is frame-shaped, the front surface section protrudes outward from an end portion of the raised section like a flange, and the illumination apparatus is recessed in a ceiling so that the front surface section is substantially flush with a surface of the ceiling.

20. The illumination apparatus according to claim 19, wherein the raised section is a lateral wall that extends from an end portion of an aperture of the front surface section toward the ceiling, and an inner surface of the lateral wall is slanted.

* * * * *